US012178299B1

(12) United States Patent
Blanch

(10) Patent No.: US 12,178,299 B1
(45) Date of Patent: Dec. 31, 2024

(54) SPINNING SNACK CONTAINER WITH ATTACHED LUNCHBOX

(71) Applicant: Tomo Technologies, Inc., Provo, UT (US)

(72) Inventor: Joseph Blanch, Raleigh, NC (US)

( * ) Notice: Subject to any disclaimer, the term of this patent is extended or adjusted under 35 U.S.C. 154(b) by 182 days.

(21) Appl. No.: 17/477,699

(22) Filed: Sep. 17, 2021

Related U.S. Application Data

(60) Provisional application No. 63/079,558, filed on Sep. 17, 2020.

(51) Int. Cl.

| | |
|---|---|
| ***A45C 11/20*** | (2006.01) |
| ***B65D 1/36*** | (2006.01) |
| ***B65D 25/32*** | (2006.01) |
| ***B65D 43/02*** | (2006.01) |

(52) U.S. Cl.
CPC ..... *A45C 11/20* (2013.01); *B65D 1/36* (2013.01); *B65D 25/32* (2013.01); *B65D 43/0202* (2013.01); *B65D 2543/00092* (2013.01); *B65D 2543/00231* (2013.01)

(58) Field of Classification Search
CPC ..... A45C 11/20; B65D 1/36; B65D 47/265; B65D 83/0454; B65D 83/0463; B65D 25/04
See application file for complete search history.

(56) References Cited

U.S. PATENT DOCUMENTS

| | | | | |
|---|---|---|---|---|
| 5,477,981 | A * | 12/1995 | Heyl | B65D 83/0454 206/533 |
| 2019/0177047 | A1* | 6/2019 | Doyle | B65D 43/26 |
| 2021/0122527 | A1* | 4/2021 | Williams | B65D 47/06 |

* cited by examiner

*Primary Examiner* — Jeffrey R Allen

(57) ABSTRACT

A snack containment and dispensing apparatus having a plurality of separate snack containment compartments, a preferably transparent lid having an opening therein, and a plunger or like means to index or rotate the lid such that access to a singular snack compartment is obtained one at a time. The apparatus is attachable through placement in recesses formed in specially designed external lunch boxes that the tray can attach to. The specially designed lunch boxes can uniquely house the spinning tray as well as provide extra storage for extra foodstuffs. The specially designed lunch boxes include handles for easy transport and carry.

10 Claims, 23 Drawing Sheets

SPINNING SNACK CONTAINER WITH ATTACHED LUNCHBOX

BACKGROUND OF THE INVENTION

Reference to Prior Application

This application claims priority of the provisional patent application 63/079,558, filed Sep. 17, 2020 entitled SNACK SPINNER LUNCHBOX COMBO by Joseph Blanch.

FIELD OF THE INVENTION

The field of this invention relates generally to the field of snack containers, and more particularly toward a spinning snack container with separate accessible compartments wherein the container is attached to a lunch box.

DESCRIPTION OF THE PRIOR ART instant invention seeks to expand on that invention that is the subject of U.S. patent application Ser. No. 16/711,491, also owned by Applicant, to include a spinning snack device that is attached to a lunchbox.

SUMMARY OF THE INVENTION

The basic embodiment of the present invention teaches a snack compartment and dispensing apparatus and lunch box combination comprising: a tray including one or more pockets; a lid connectible with said tray and including an opening, said tray being configured for selective rotation relative said lid to align one of said one or more pockets with said opening; an actuator configured to actuate rotation of said tray, said actuator including a rotation mechanism that includes a base and a tubular portion, said tubular portion including a plurality of vertical channels connected by a plurality of transverse channels to facilitate selective rotation of said tray; and a specialized detachable lunch box wherein said lunch box includes a recessed portion for the placement thereon of said tray and securement thereto.

The above embodiment can be further modified by defining that said specialized detachable lunch box has a handle attached thereto.

The above embodiment can be further modified by defining that said detachable lunch box includes at least one compartment for the secure placement therein of food items wherein said compartment can be opened and closed.

The above embodiment can be further modified by defining that said at least one compartment is positioned adjacent to said recessed portion.

The above embodiment can be further modified by defining that said at least one compartment is positioned below said recessed portion.

An alternate embodiment provides for a snack containment and dispensing apparatus and lunch box combination comprising: a bowl; a lid connectible with said bowl, said lid including an opening having a hinged flap; a tray disposed with said bowl, said tray including one or more pockets configured for selective rotation relative to said bowl to align one of said one or more pockets with said opening; a plunger button configured to actuate rotation of said tray, said plunger button including a rotation mechanism that includes a base and a tubular portion, said tubular portion including a plurality of vertical channels connected by a plurality of transverse channels to facilitate selective rotation of said tray; and a specialized detachable lunch box wherein said lunch box includes a recessed portion for the placement thereon of said tray and securement thereto.

The above embodiment can be further modified by defining that said specialized detachable lunch box has a handle attached thereto.

The above embodiment can be further modified by defining that said detachable lunch box includes at least one compartment for the secure placement therein of food items wherein said compartment can be opened and closed.

The above embodiment can be further modified by defining that said at least one compartment is positioned adjacent to said recessed portion.

The above embodiment can be further modified by defining that said at least one compartment is positioned below said recessed portion.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1:
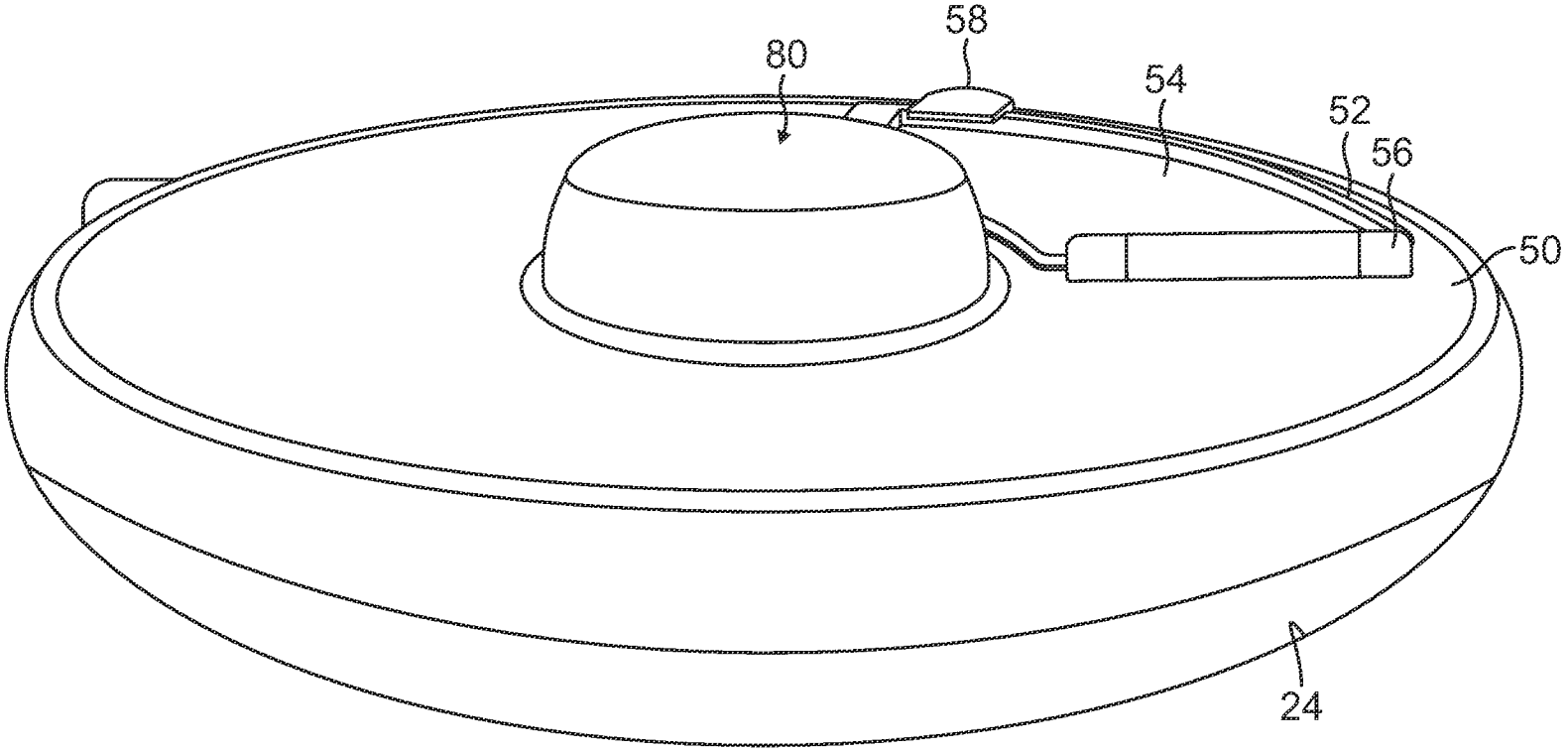
FIG. 1 is a perspective view of the components of one embodiment of a snack containment and dispensing apparatus in accordance with the principles of the present disclosure as defined in U.S. patent application Ser. No. 16/711,491 without the attachment to a lunch box.

Turning to the drawings, the preferred embodiment is illustrated and described by reference characters that denote similar elements throughout the several views of the instant invention.

The preferred embodiment of the instant invention provides for a snack containment and dispensing apparatus in accordance with the principles of the present disclosure. Alternate embodiments are also disclosed. Reference is made in detail to the exemplary embodiments of the present disclosure, which are illustrated in the accompanying figures. Turning to FIG. 1-22, there are illustrated components of a snack containment and dispensing apparatus, such as, for example, a container system 10. Container system 10 is configured to allow access to one compartment of a tray at a time by providing for selective rotation of the tray for alignment with an opening disposed with a lid. The system is attached in the present disclosure to two exemplary lunch boxes wherein additional food can be stored.

Figure 2:
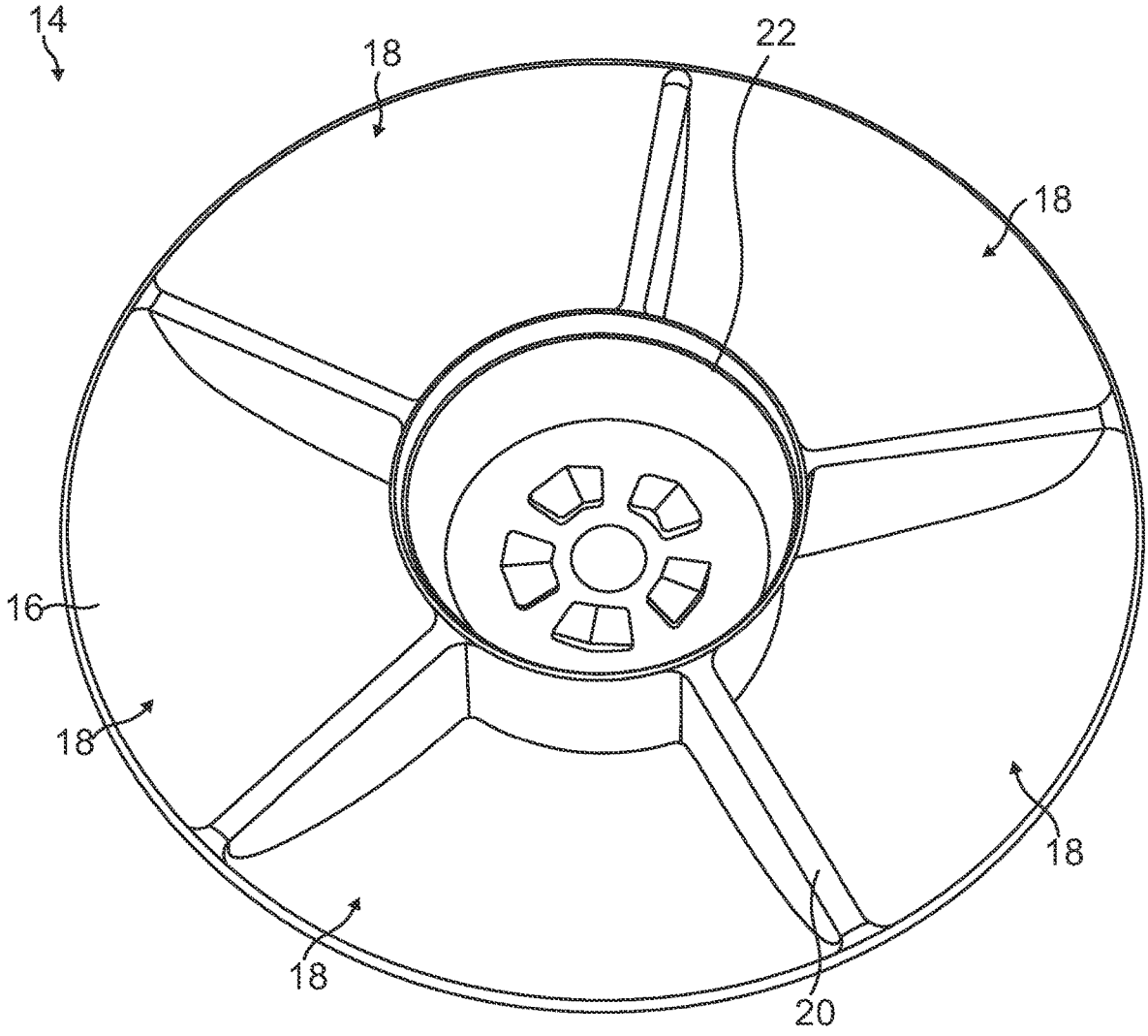
FIG. 2 is a plan view of the components of one embodiment of a snack containment and dispensing apparatus in accordance with the principles of the instant invention as defined in U.S. patent application Ser. No. 16/711,491 without the attachment to a lunch box.
Figure 3:
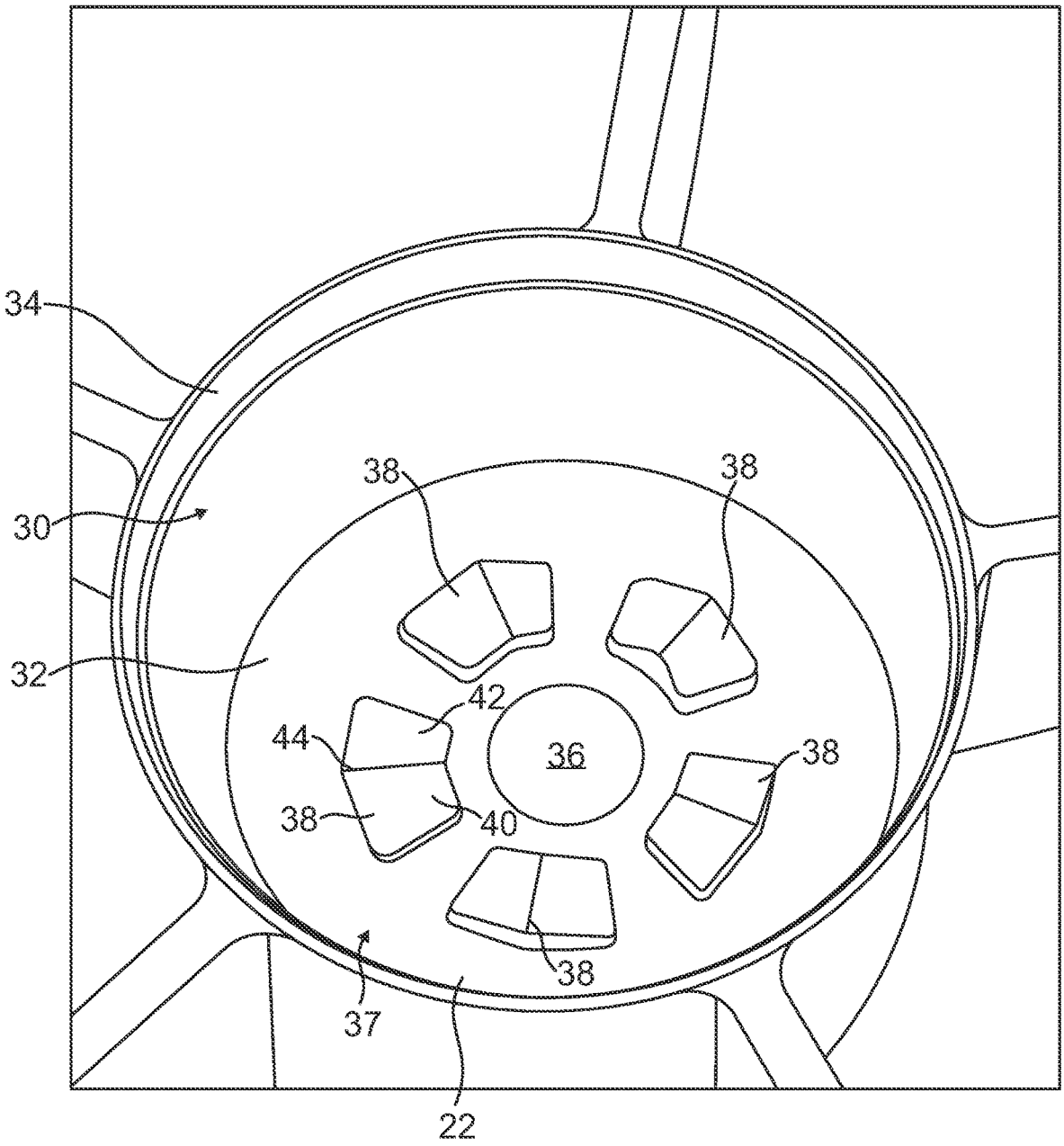
FIG. 3 is an enlarged view of the components of FIG. 2.

The container system 10 includes a tray 14 configured to contain snacks S therein. Tray 14 includes a substantially round dish shaped member. Tray 14 includes a surface 16 that defines one or more containment compartments, e.g., pockets 18. Pockets 18 are separated by walls 20. Pockets 18 may include various configurations, for example, the pockets can be oval-shaped, oblong, triangular, square, polygonal, irregular, uniform, non-uniform, offset, staggered, and/or tapered. Pockets 18 are circumferentially disposed about a central opening 22, as shown in FIG. 2. Snacks S are disposable within pockets 18, as shown in FIGS. 2-3. Walls 20 provide a separation between snacks S. Tray 14 is selectively rotatable to provide access to one of the pockets 18, as described herein. Tray 14 includes an outer bottom surface that defines a cavity 23.

Figure 4:
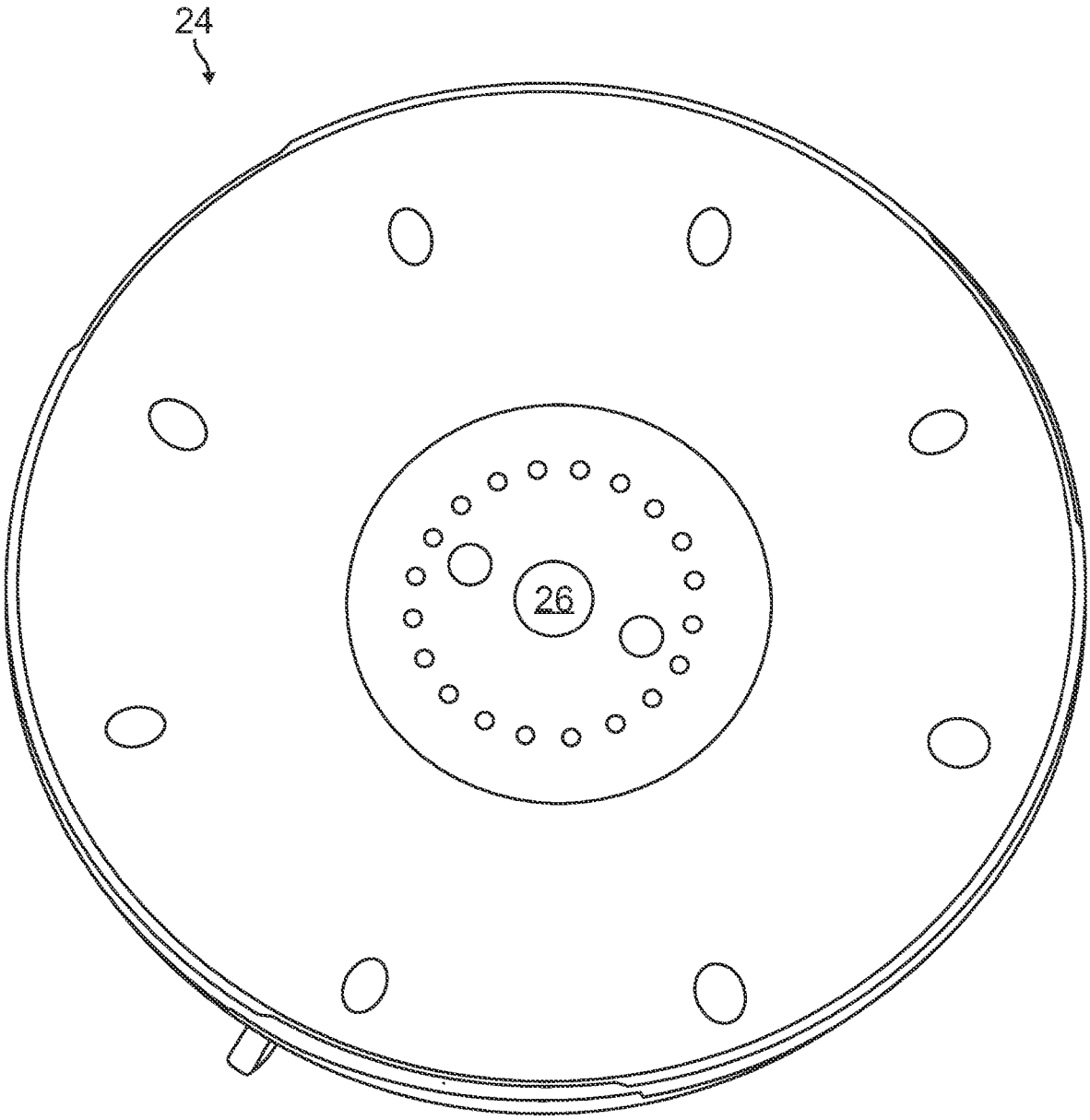
FIG. 4 is a plan view of the components of one embodiment of a snack containment and dispensing apparatus in accordance with the principles of the instant invention as defined in U.S. patent application Ser. No. 16/711,491 without the attachment to a lunch box.
Figure 5:
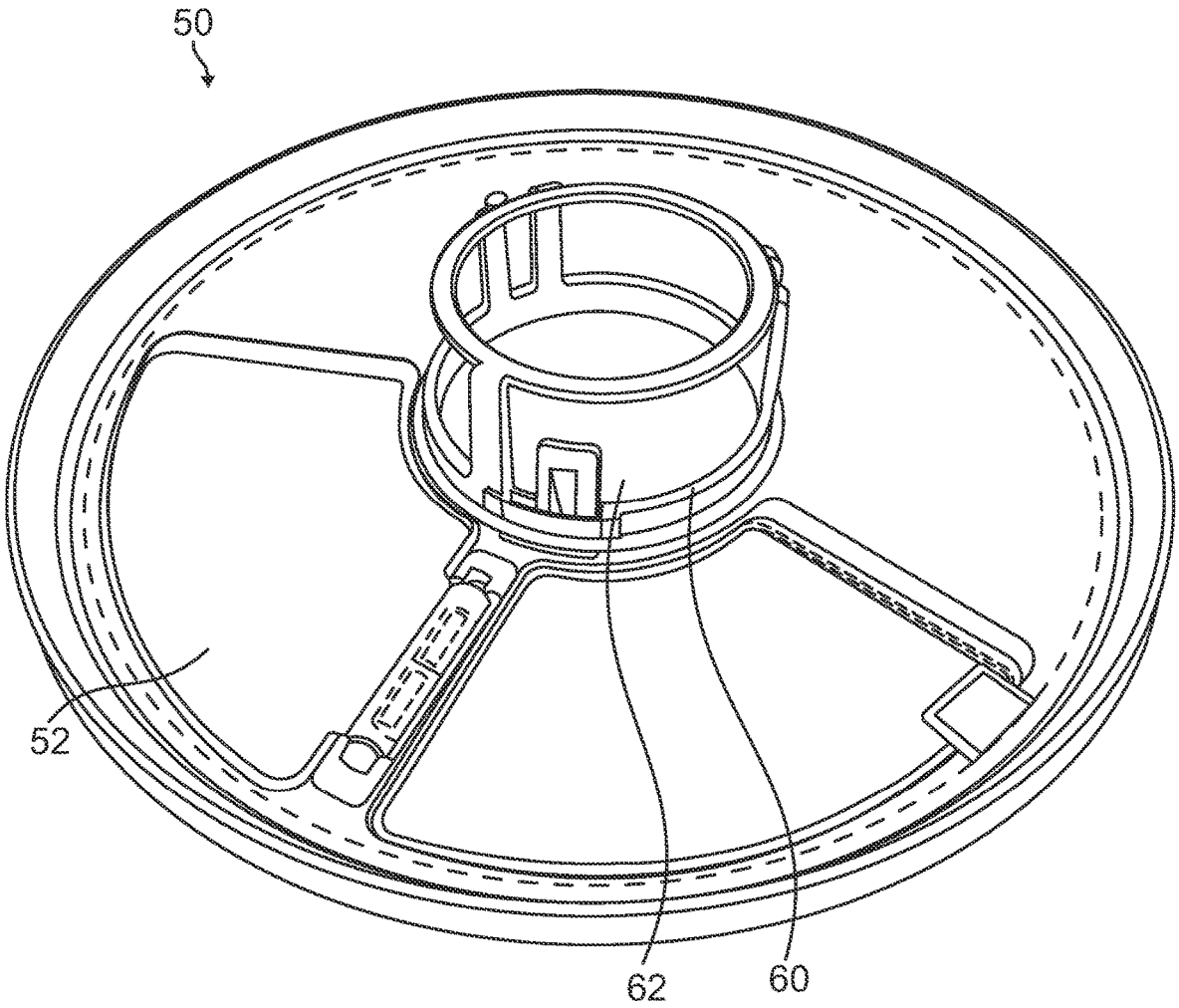
FIG. 5 is a plan view of the components of one embodiment of a snack containment and dispensing apparatus in accordance with the principles of the instant invention as defined in U.S. patent application Ser. No. 16/711,491 without the attachment to a lunch box.
Figure 6:
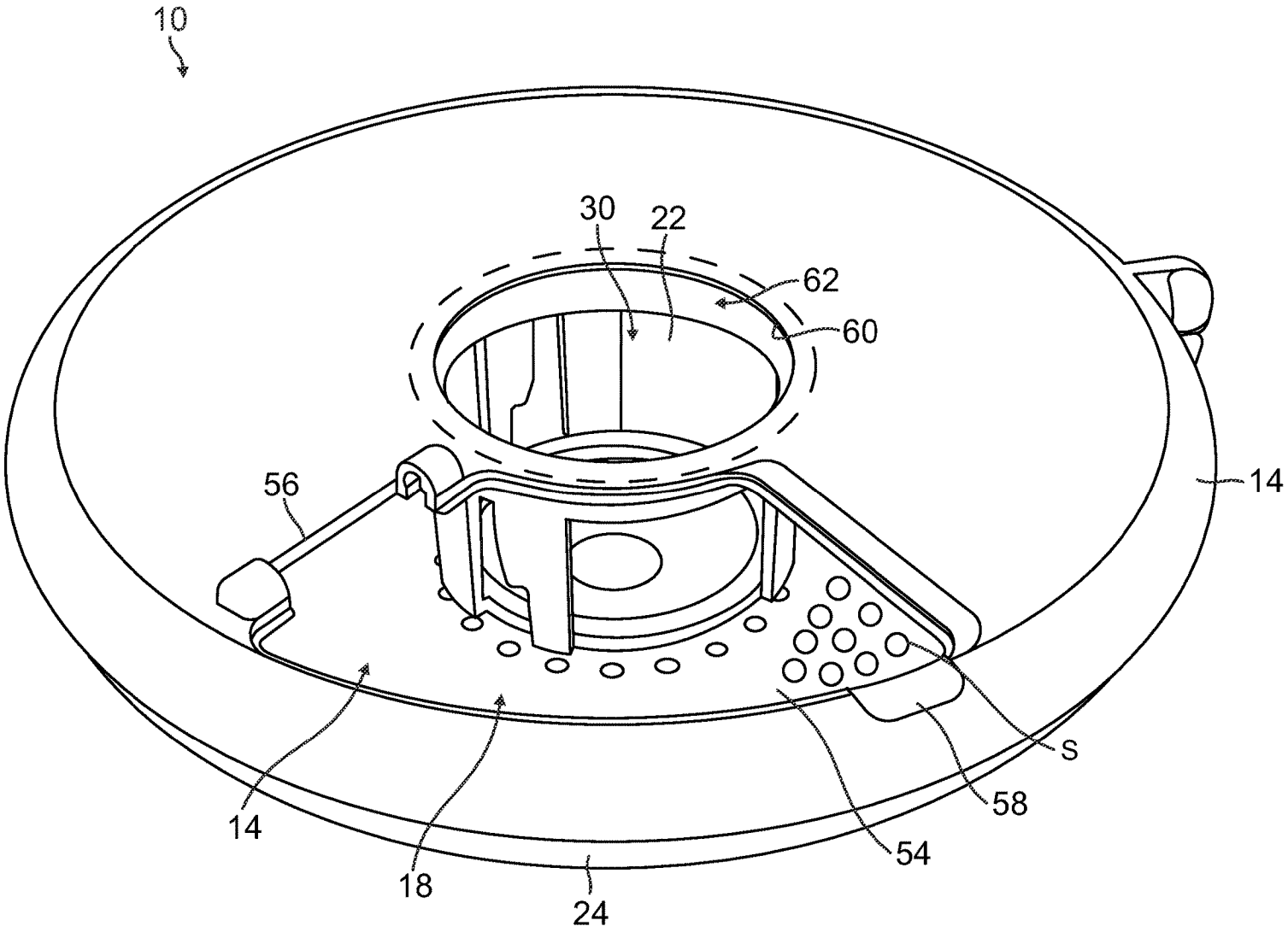
FIG. 6 is a perspective view of the components of one embodiment of a snack containment and dispensing apparatus in accordance with the principles of the instant invention as defined in U.S. patent application Ser. No. 16/711,491 without the attachment to a lunch box.
Figure 7:
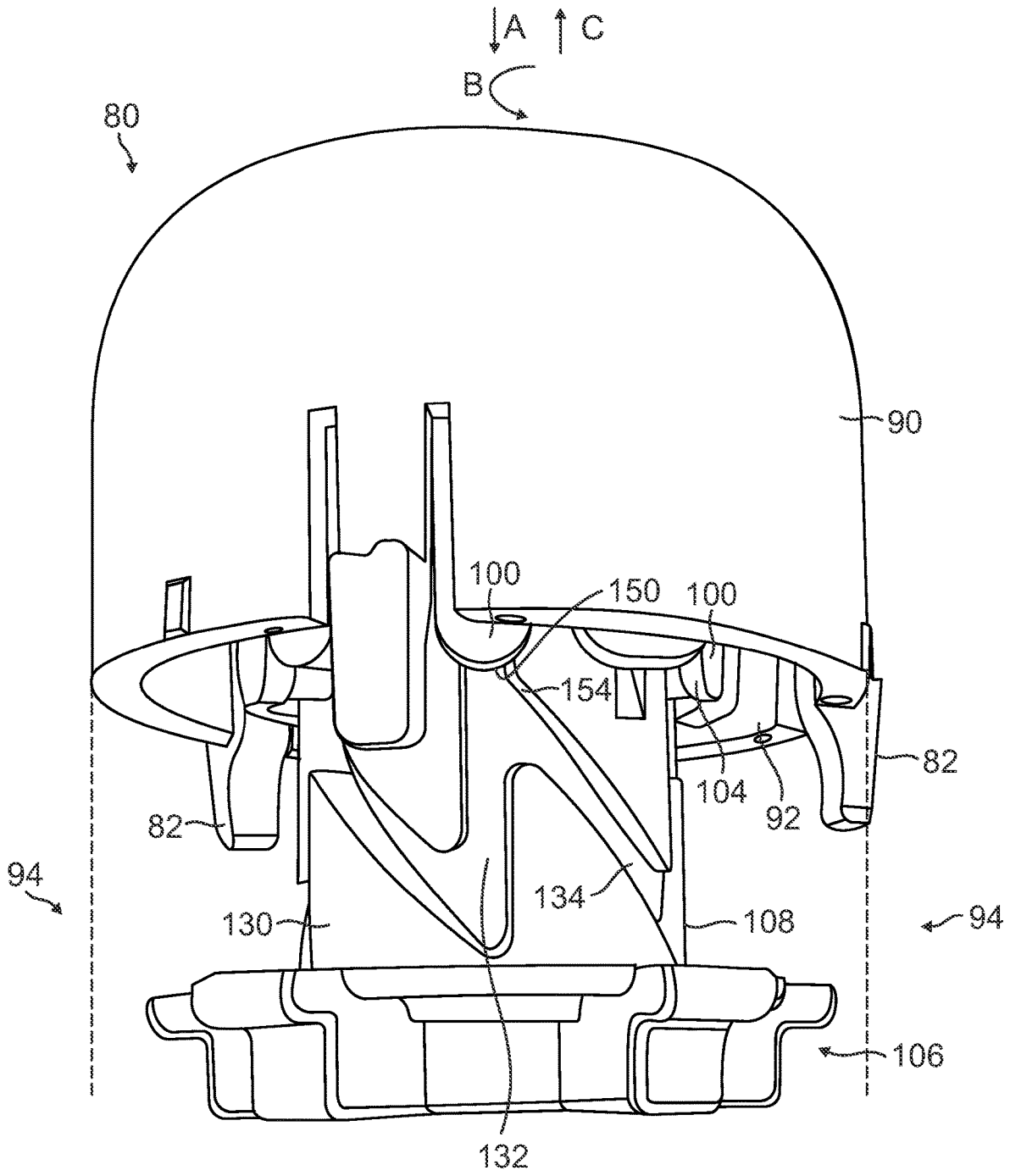
FIG. 7 is a perspective view of the components of one embodiment of a snack containment and dispensing apparatus in accordance with the principles of the instant invention as defined in U.S. patent application Ser. No. 16/711,491 without the attachment to a lunch box.

In some embodiments, tray 14 is disposed with a bowl 24. Bowl includes an inner bottom surface that defines a protrusion, for example, a spindle 26, as shown in FIG. 4. Spindle 26 is configured for disposal with cavity 23 to facilitate rotation of tray 14 relative to bowl 24, as described herein.

Opening 22 defines a housing 30. Housing 30 includes a bottom surface 32 and a side wall 34. Housing 30 is configured for disposal of an actuator 80, a described herein. Housing 30 is substantially centrally located with tray 14 such that pockets 18 are disposed circumferentially about housing 30. Surface 32 includes an upwardly projecting spindle protrusion 36 and a plurality of drive knobs 38 substantially equidistantly located circumferentially about protrusion 36. Knobs 38 are separated by a gap 37. Knob 38 each include a first ramp surface 40 and a second ramp surface 42. Surface 40 and surface 42 merge at an apex 44. In operation, a portion of actuator 80 is configured to translate along ramp surface 40 over apex 44 and along ramp surface 42 and into gap 37. When the portion of actuator 80 is disposed with gap 37, actuator is releasably fixed with tray 14 to resist and/or prevent rotation, as described herein. In some embodiments, knobs 38 are equally distributed. In some embodiments, the number of knobs 38 equals the number of pockets 18 to facilitate alignment of pockets 18 with opening 52, as described herein.

To keep snacks S from falling out of tray 14 during transport and/or maintain the freshness of snacks S, tray 14 includes a lid 50, as sown in FIGS. 1, 5, 12-22. Lid 50 is substantially clear for viewing snacks S therethrough. Lid 50 includes a substantially round, circular shape configured to fit with tray 14.

Lid 50 includes an opening 52 that is sized for alignment with one of the pockets 18 to allow access to snacks S. Lid 50 includes a hinged flap 54 disposed with opening 52. Flap 54 is configured for disposal and alignment relative to a pocket 18 to allow access to snacks S. flap 54 is configured for rotation about a hinge 56 for disposal between a closed orientation and an open orientation. Flap 54 includes a lock 58 that is configured to engage a surface of tray 14. In some embodiments, lock 58 is engaged with tray 14 via an integral connection, friction fit, pressure fit, interlocking engagement, mating engagement, dovetail connection, clips, barbs, tongue in groove, threaded, magnetic and/or key/keyslot.

Lid 50 includes a surface 60 that defines an opening 62. Opening 62 is aligned with housing 30 and configured for disposal of actuator 80, as described herein. Lid 50 is fixed with a portion of actuator 80 such that upon actuation of actuator 80, tray 14 is rotated relative to lid 50 to expose a single pocket 18. In some embodiments, actuator 80 includes spring tabs 82 configured to engage a portion of lid 50 to releasably fix actuator 80 with lid 50 to resist and/or prevent rotation of actuator 80 relative to lid. In some embodiments, lid 50 is connected with actuator 80 via an integral connection, friction fit, pressure fit, interlocking engagement, mating engagement, dovetail connection, clips, barbs, tongue in groove, threaded, magnetic and/or key/keyslot.

Actuator 80 includes a button 90, a collar 92, a rotation mechanism 94 and a housing 96. Button 90 includes a circular configuration and is configured to be pressed to actuate actuator 80, as described herein. In some embodiments, actuator 80 is configured as a plunger button.

Collar 92 is disposed with a cavity of button 90. Collar 92 includes a plurality of resiliently biased arms 100. One or more arms 100 includes a pin 104 protruding inwardly. Pins 104 are configured to engage a portion of rotation mechanism 94 to facilitate selective rotation, as described herein. Button 90 is moveable between a release orientation and locked orientation. In the release orientation, button 90 is biased upwards and can be pressed axially to actuate rotation of rotation mechanism 94. In the locked orientation, button 90 is fixed in a depressed orientation to resist and/or prevent rotation.

Figure 8:
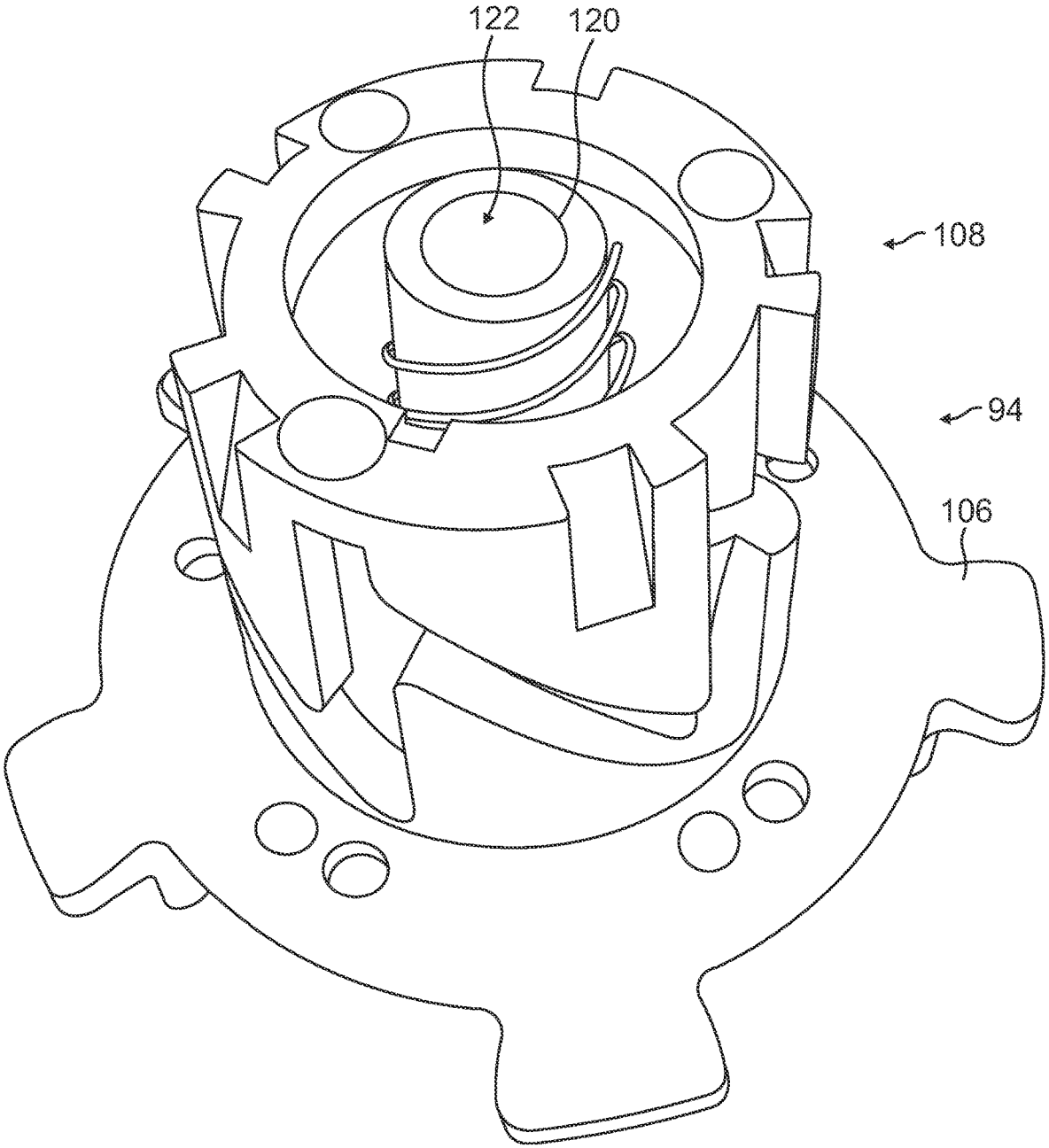
FIG. 8 is a perspective view of the components of one embodiment of a snack containment and dispensing apparatus in accordance with the principles of the instant invention as defined in U.S. patent application Ser. No. 16/711,491 without the attachment to a lunch box.
Figure 9:
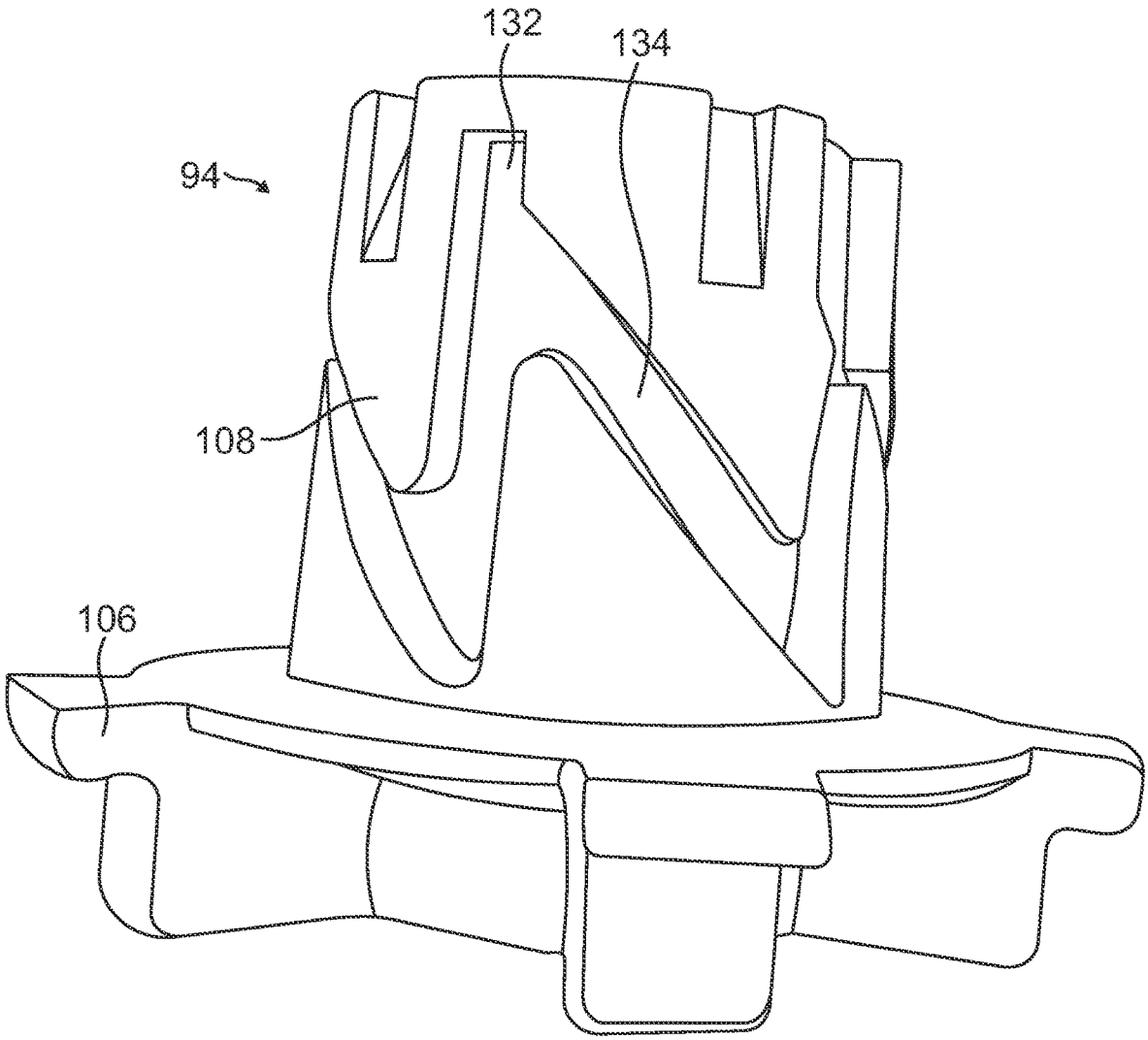
FIG. 9 is a side view of the components of one embodiment of a snack containment and dispensing apparatus in accordance with the principles of the instant invention as defined in U.S. patent application Ser. No. 16/711,491 without the attachment to a lunch box.
Figure 10:
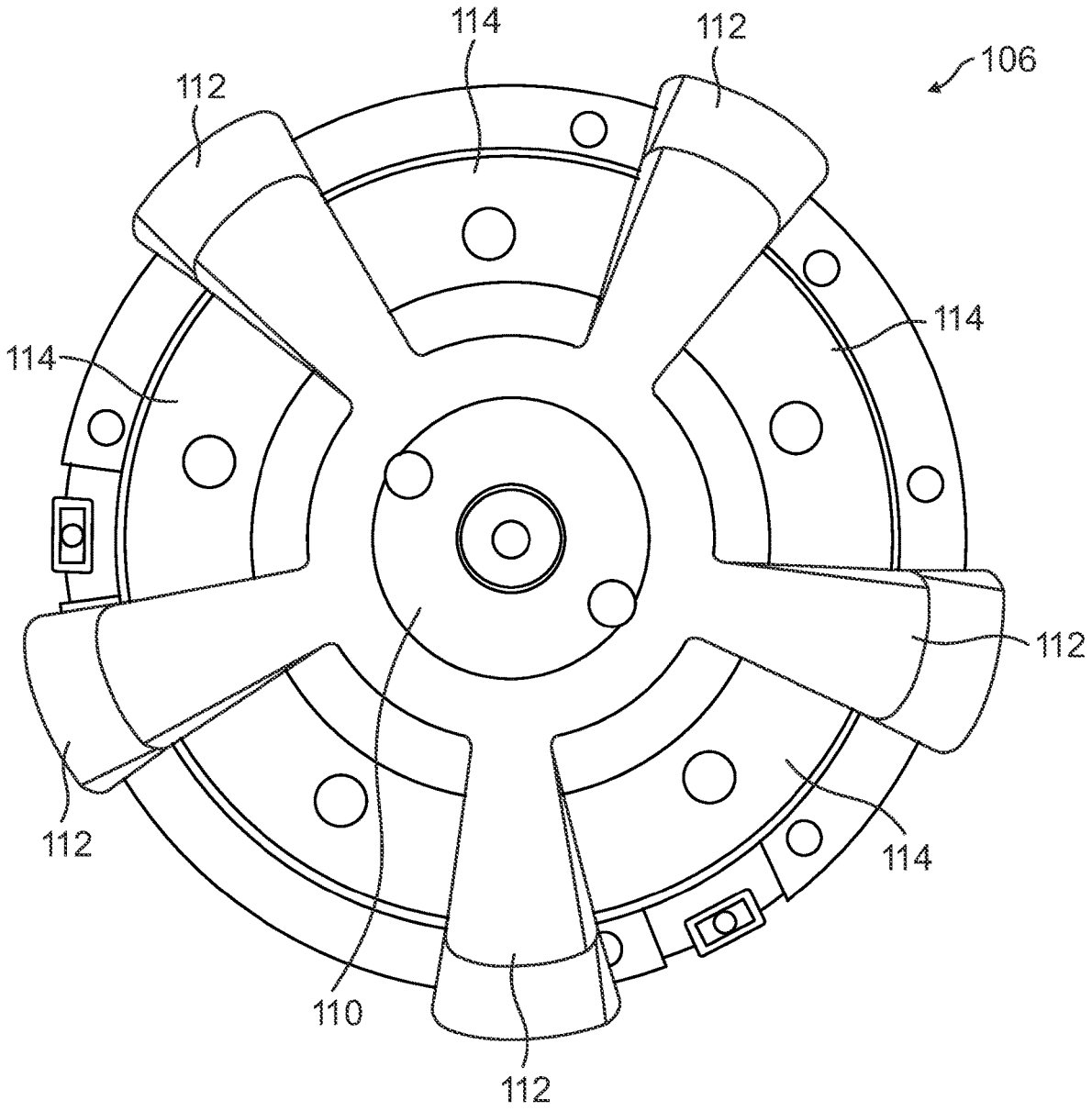
FIG. 10 is a bottom view of the components of one embodiment of a snack containment and dispensing apparatus in accordance with the principles of the instant invention as defined in U.S. patent application Ser. No. 16/711,491 without the attachment to a lunch box.
Figure 11:
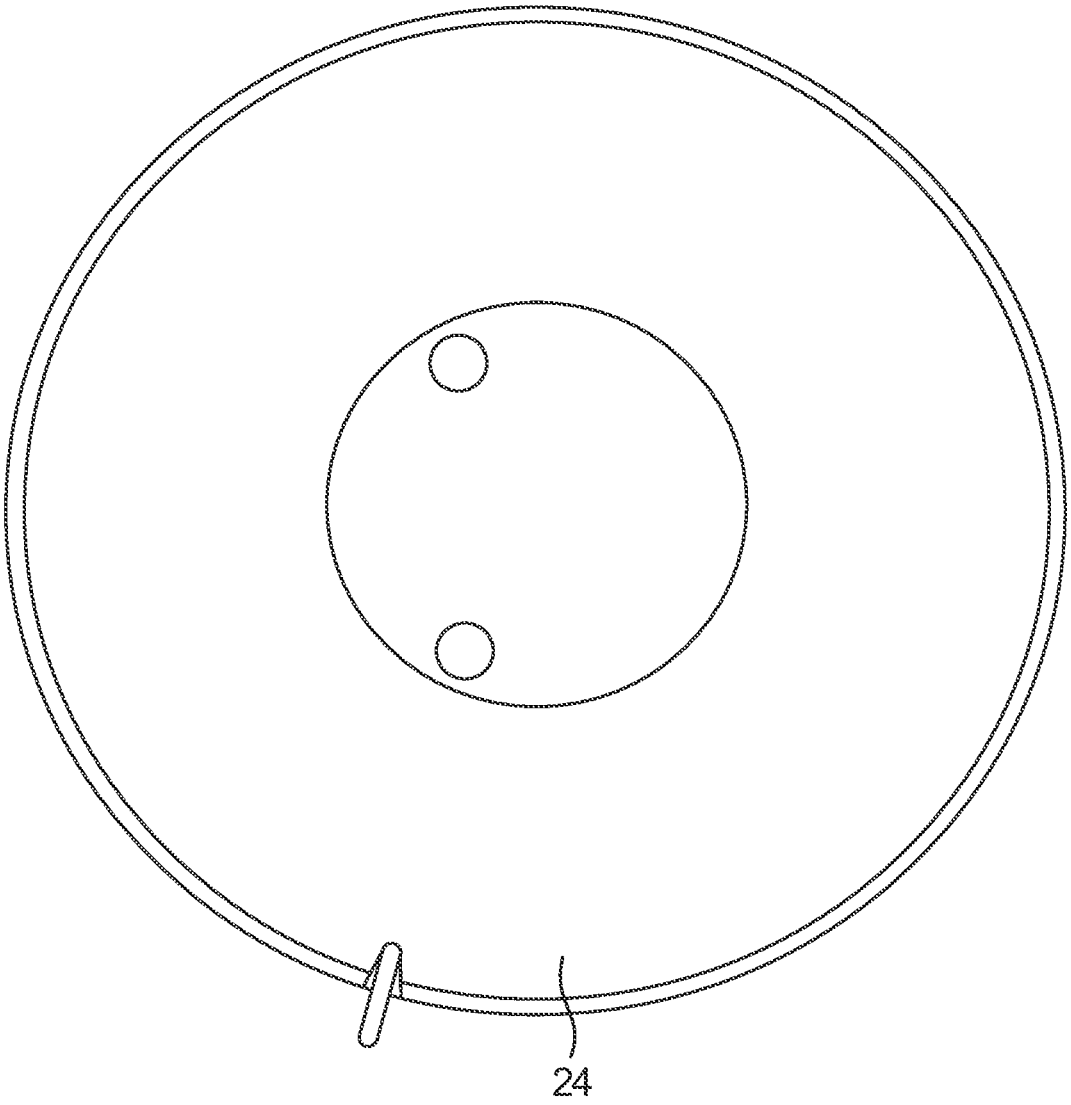
FIG. 11 is a bottom view of the components of one embodiment of a snack containment and dispensing apparatus in accordance with the principles of the instant invention as defined in U.S. patent application Ser. No. 16/711,491 without the attachment to a lunch box.
Figure 12:
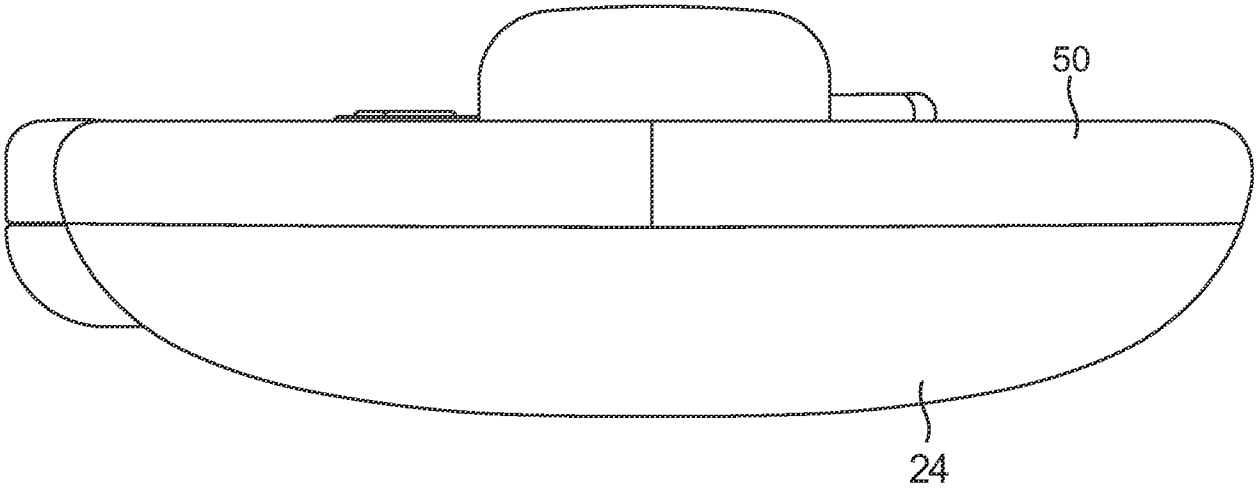
FIG. 12 is a side view of the components of one embodiment of a snack containment and dispensing apparatus in accordance with the principles of the instant invention as defined in U.S. patent application Ser. No. 16/711,491 without the attachment to a lunch box.
Figure 13:
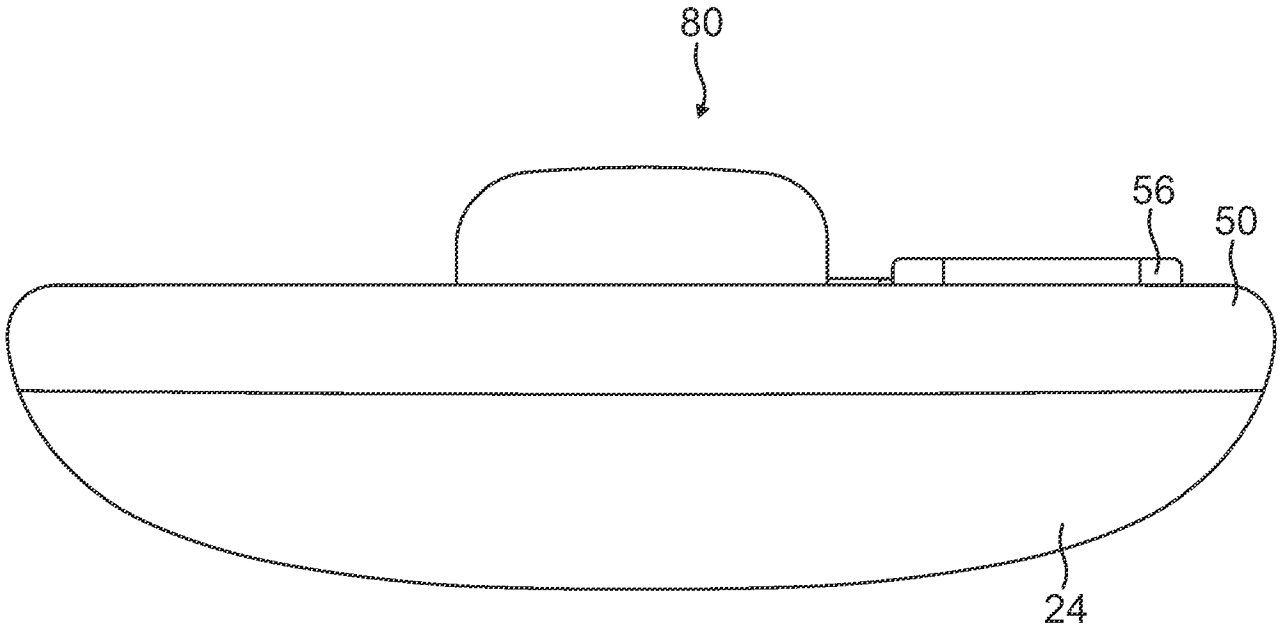
FIG. 13 is a side view of the components of one embodiment of a snack containment and dispensing apparatus in accordance with the principles of the instant invention as defined in U.S. patent application Ser. No. 16/711,491 without the attachment to a lunch box.
Figure 14:
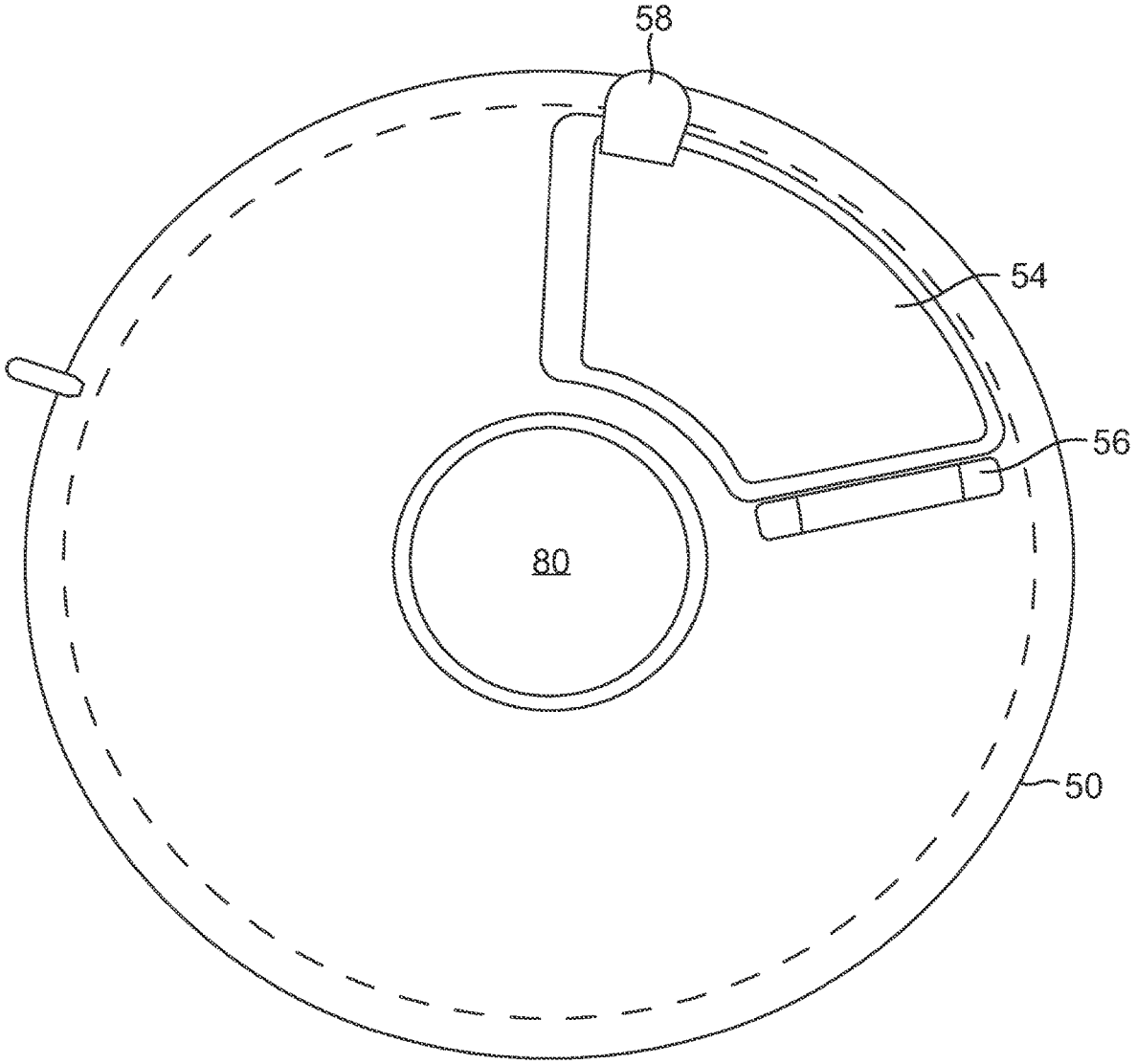
FIG. 14 is a top view of the components of one embodiment of a snack containment and dispensing apparatus in accordance with the principles of the instant invention as defined in U.S. patent application Ser. No. 16/711,491 without the attachment to a lunch box.
Figure 15:
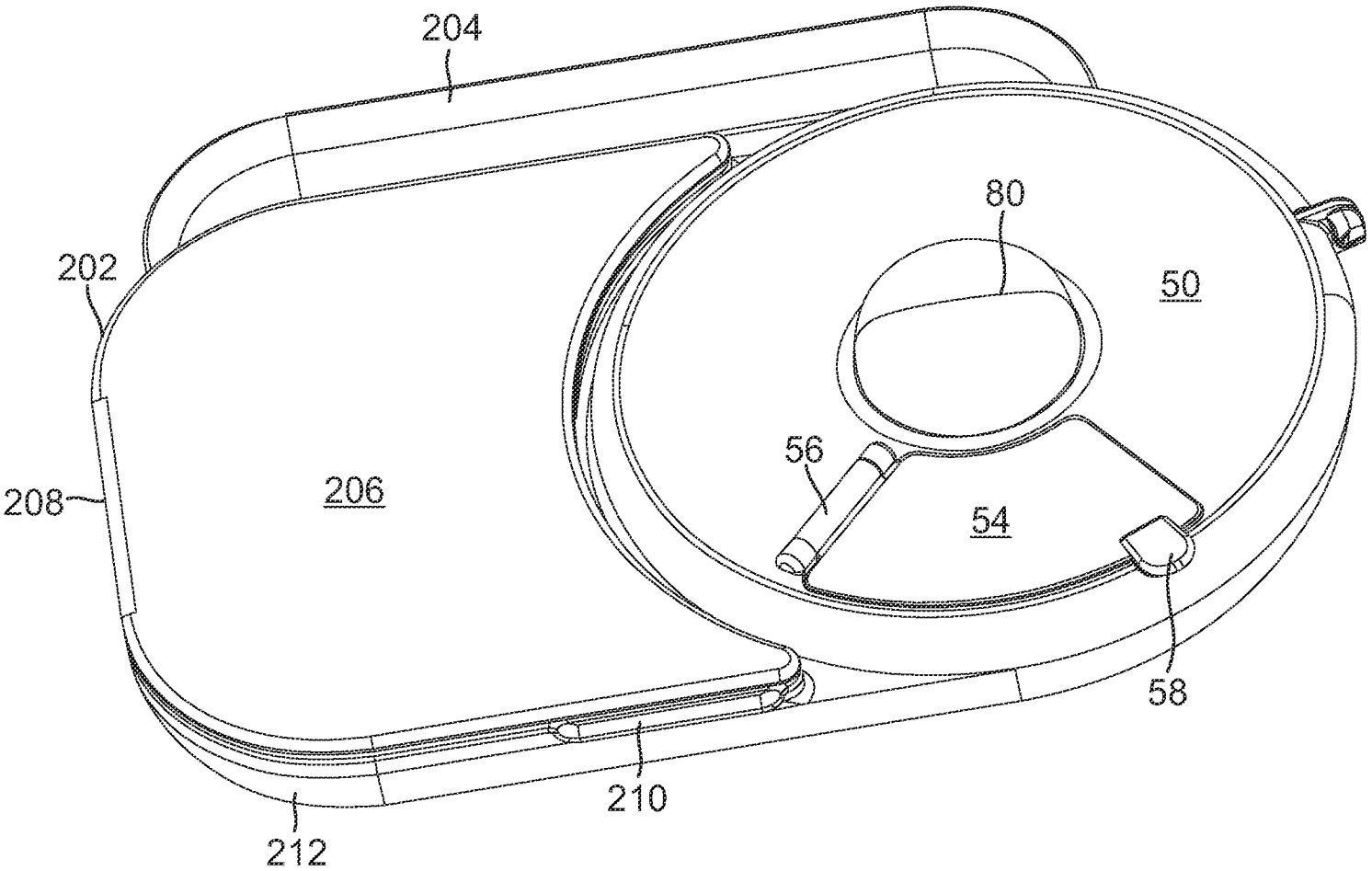
FIG. 15 is a perspective view of the components of one embodiment of a snack containment and dispensing apparatus in accordance with the principles of the instant invention wherein a lunch box is attached to the invention as defined in U.S. patent application Ser. No. 16/711,491.
Figure 16:
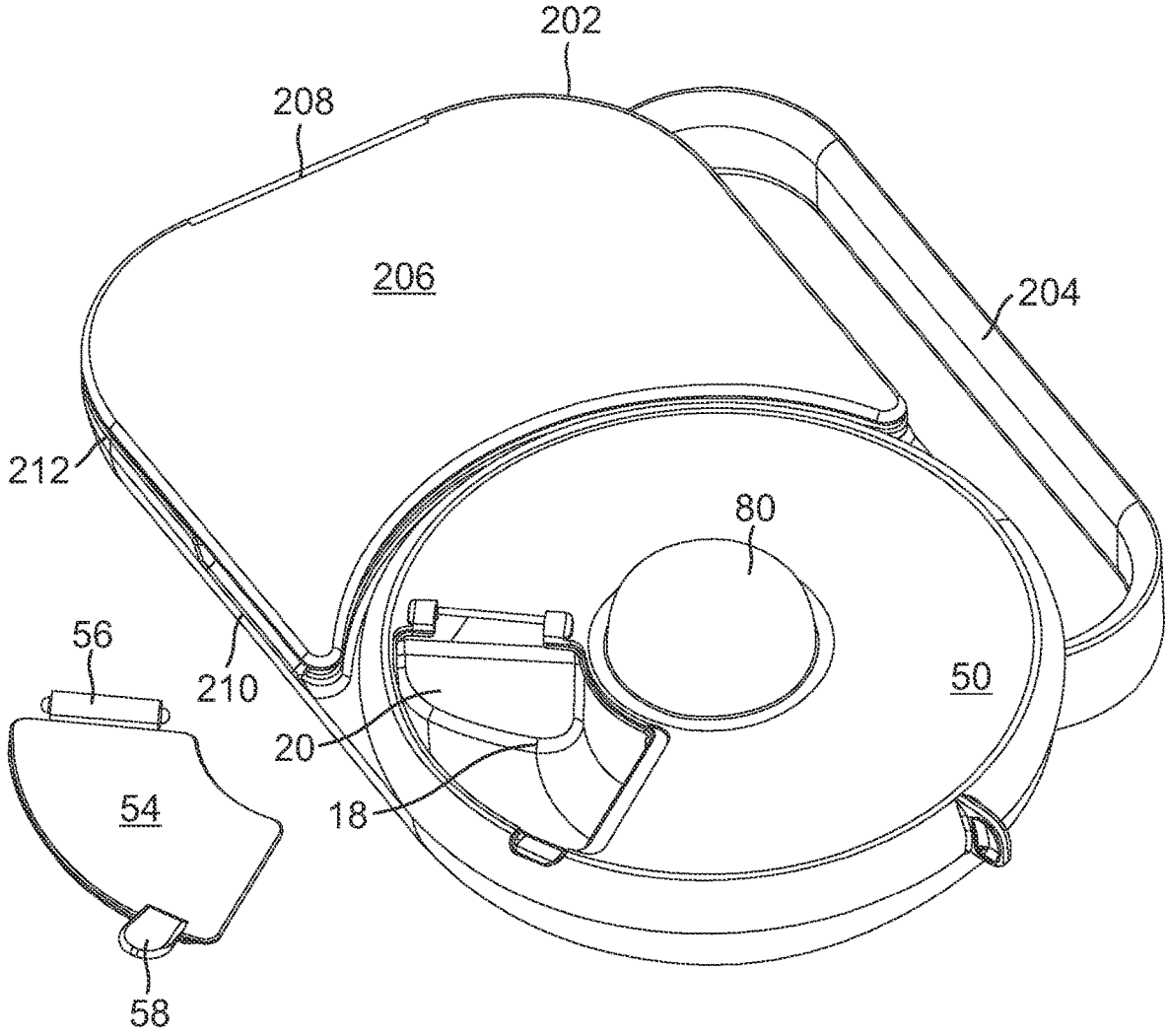
FIG. 16 is a perspective view as shown in FIG. 15 but with the lid to the access compartment exploded away.
Figure 17:
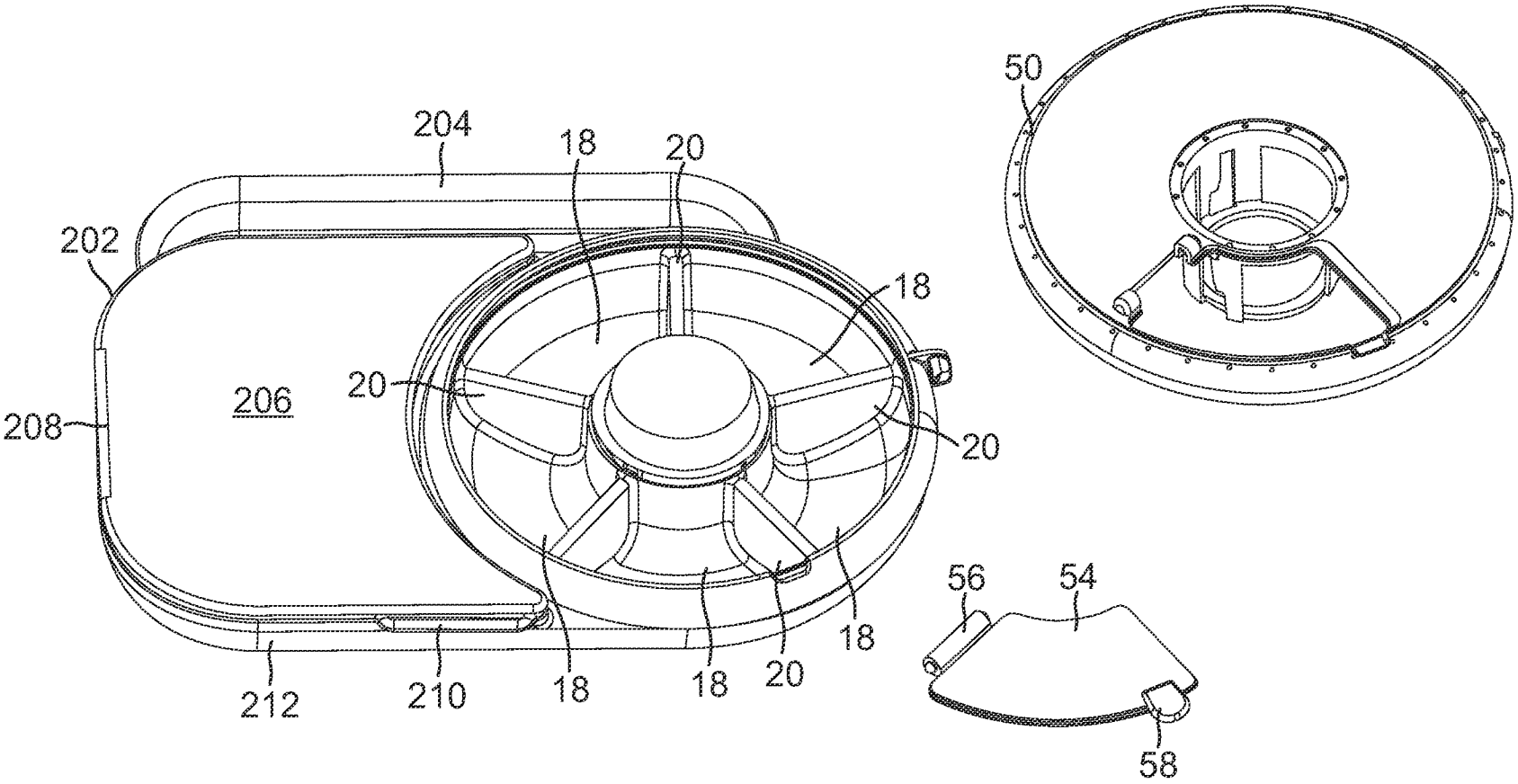
FIG. 17 is a perspective view as shown in FIG. 15 with the entire lid removed such that the internal compartments are visible.
Figure 18:
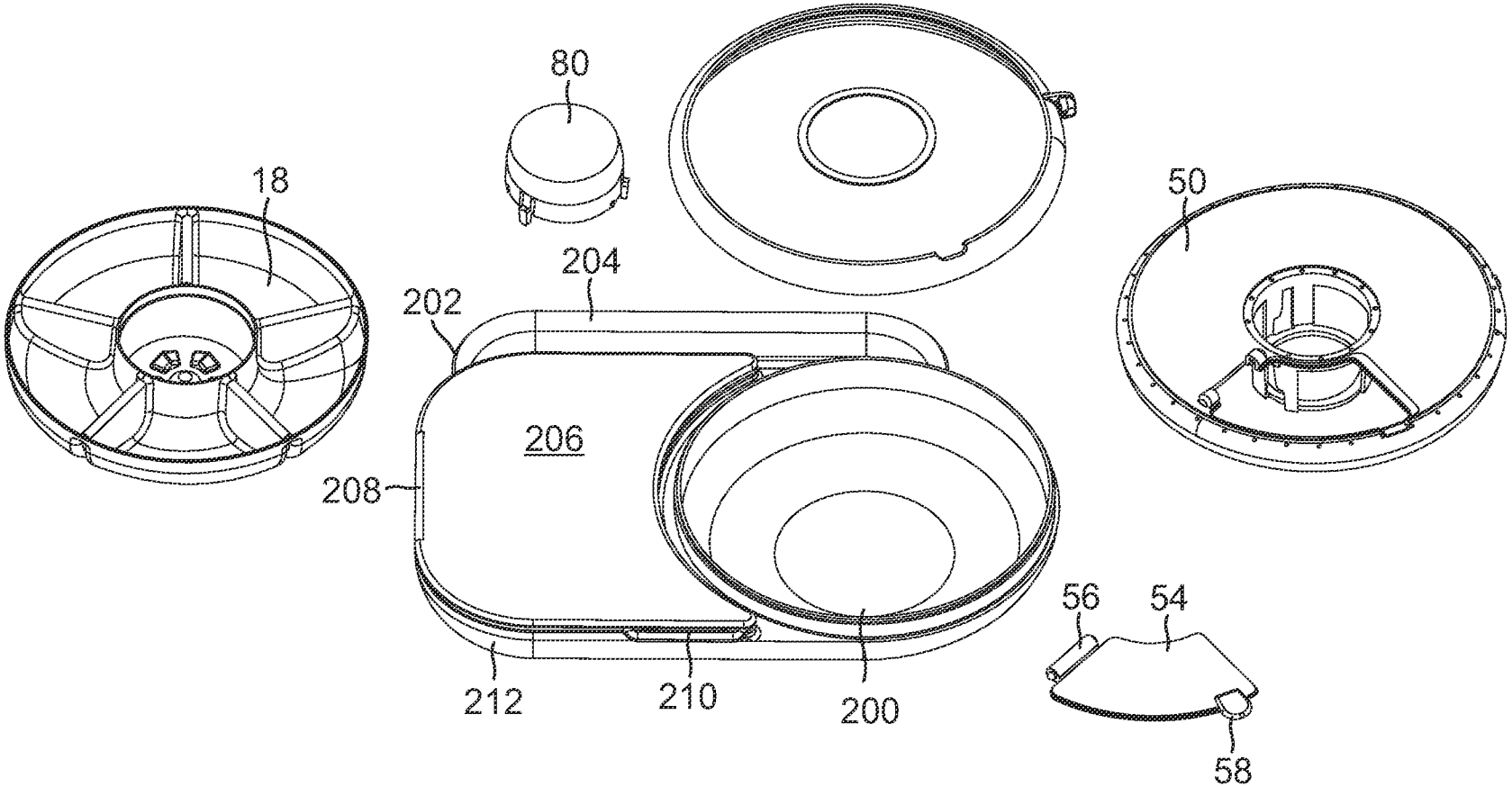
FIG. 18 is an exploded view of FIG. 15.
Figure 19:
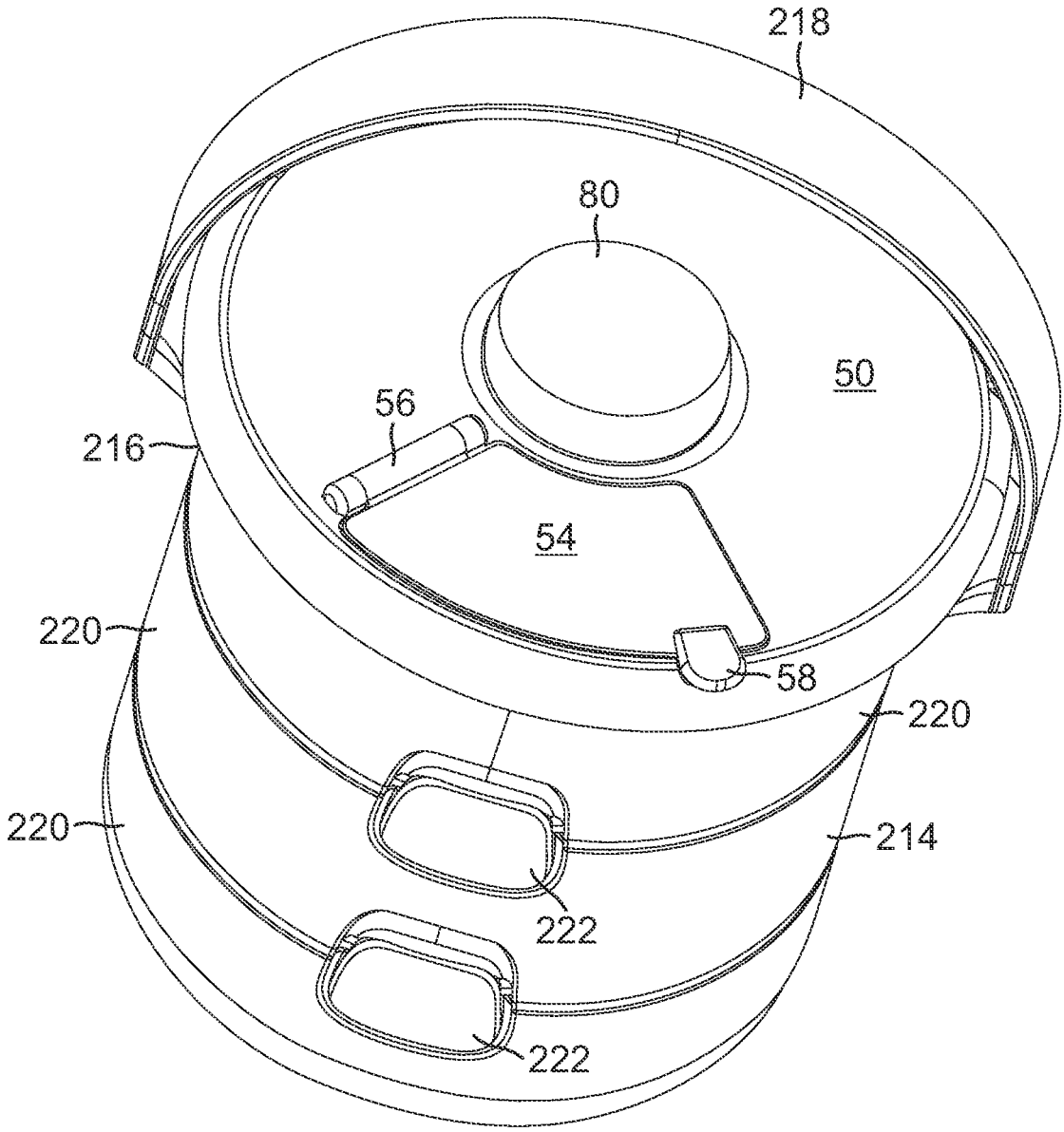
FIG. 19 is a perspective view of the components of a second embodiment of a snack containment and dispensing apparatus in accordance with the principles of the instant invention wherein an alternate style of lunch box is attached to the invention as defined in U.S. patent application Ser. No. 16/711,491.
Figure 20:
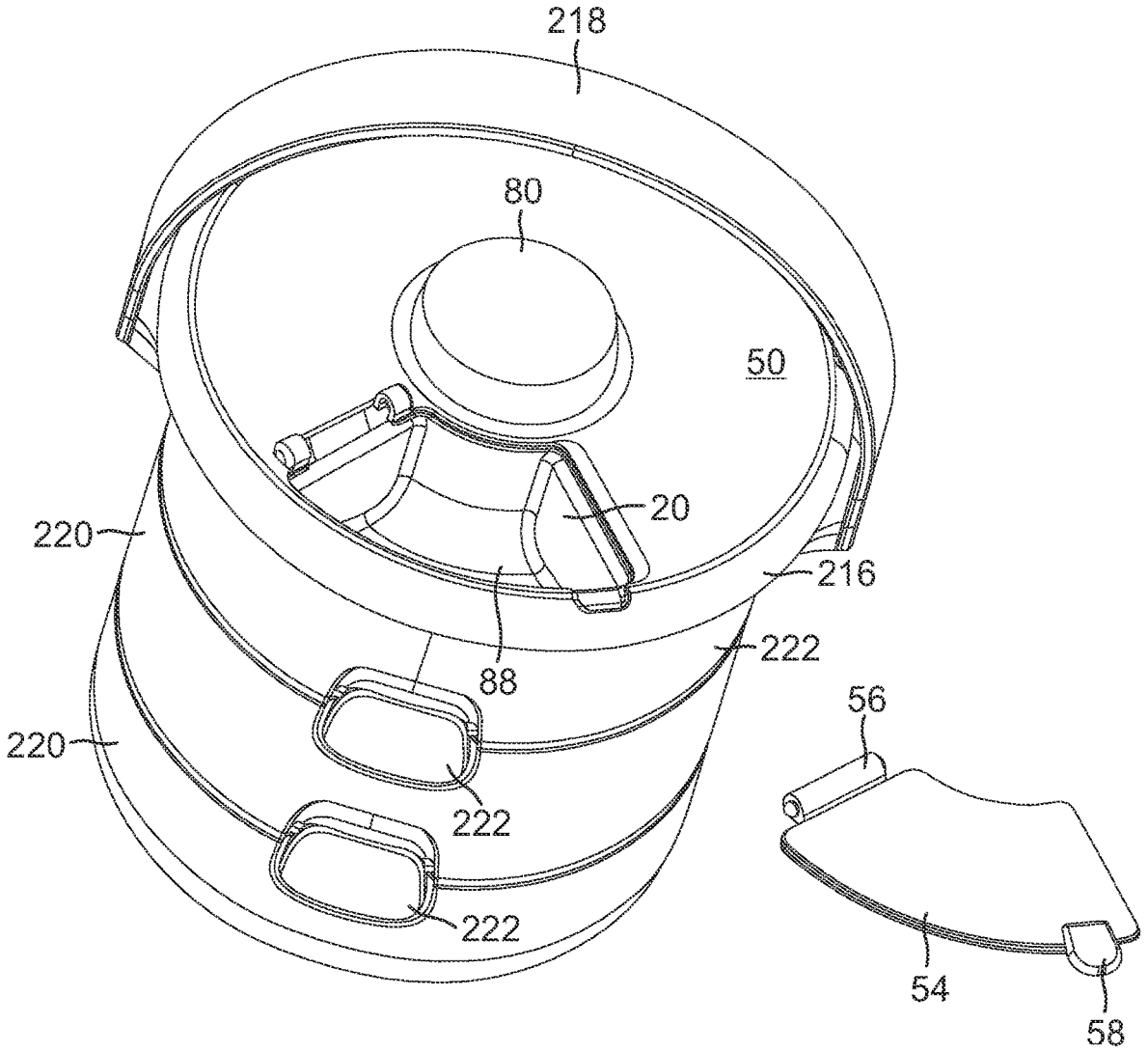
FIG. 20 is a perspective view as shown in FIG. 19 but with the lid to the access compartment exploded away.
Figure 21:
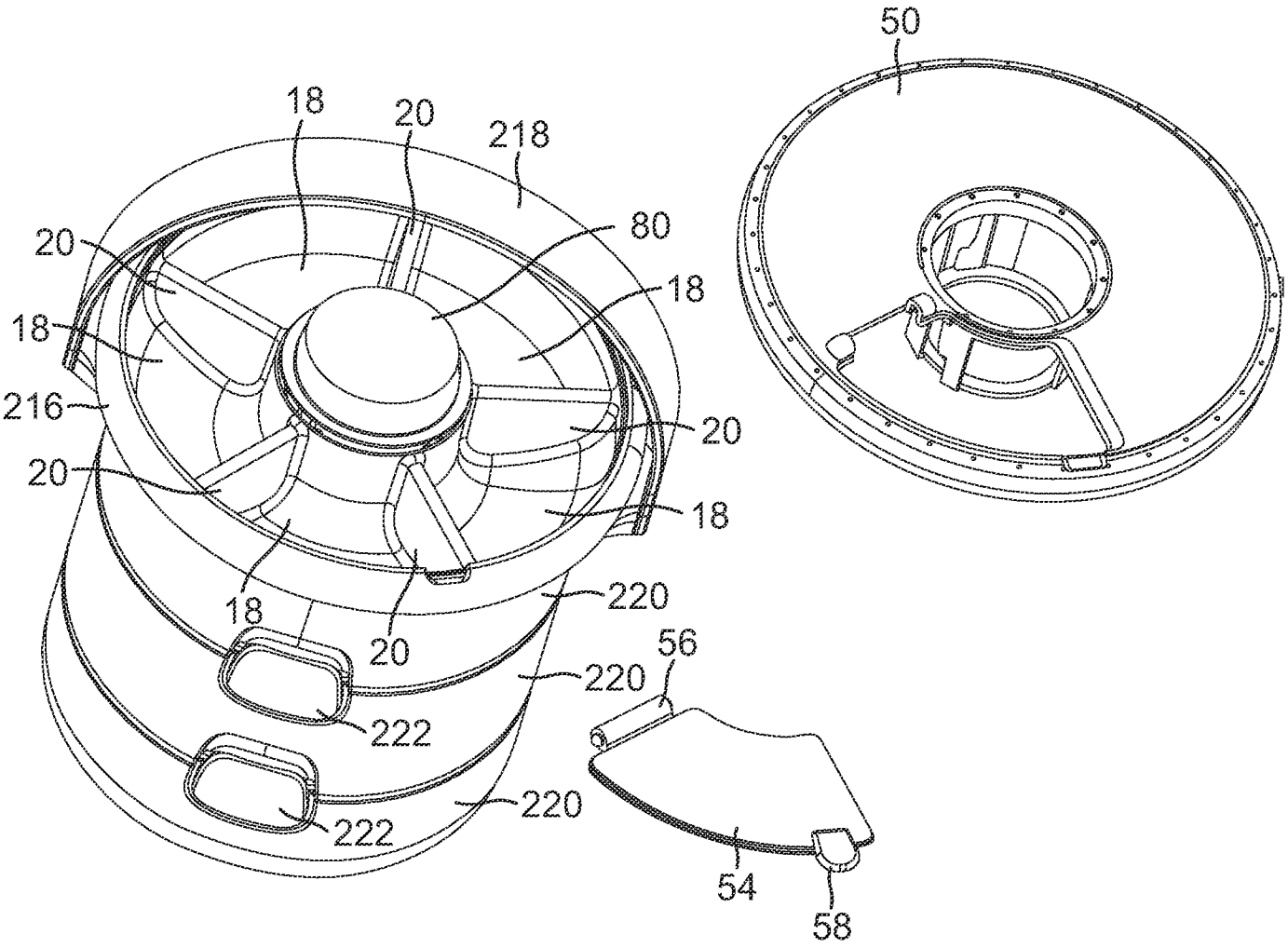
FIG. 21 is a perspective view as shown in FIG. 19 with the entire lid removed such that the internal components are visible.
Figure 22:
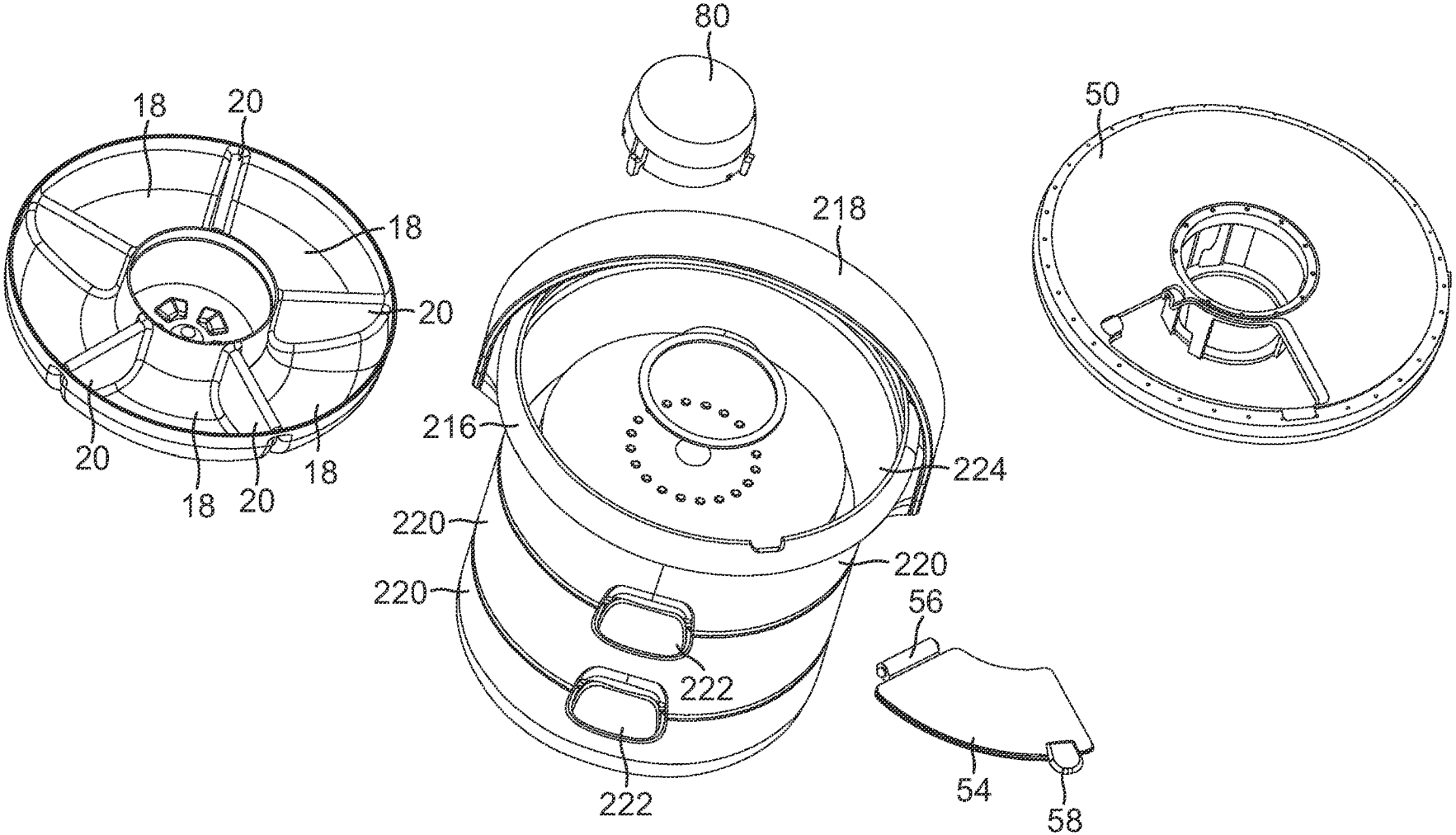
FIG. 22 is an exploded view of FIG. 19.
Figure 23:
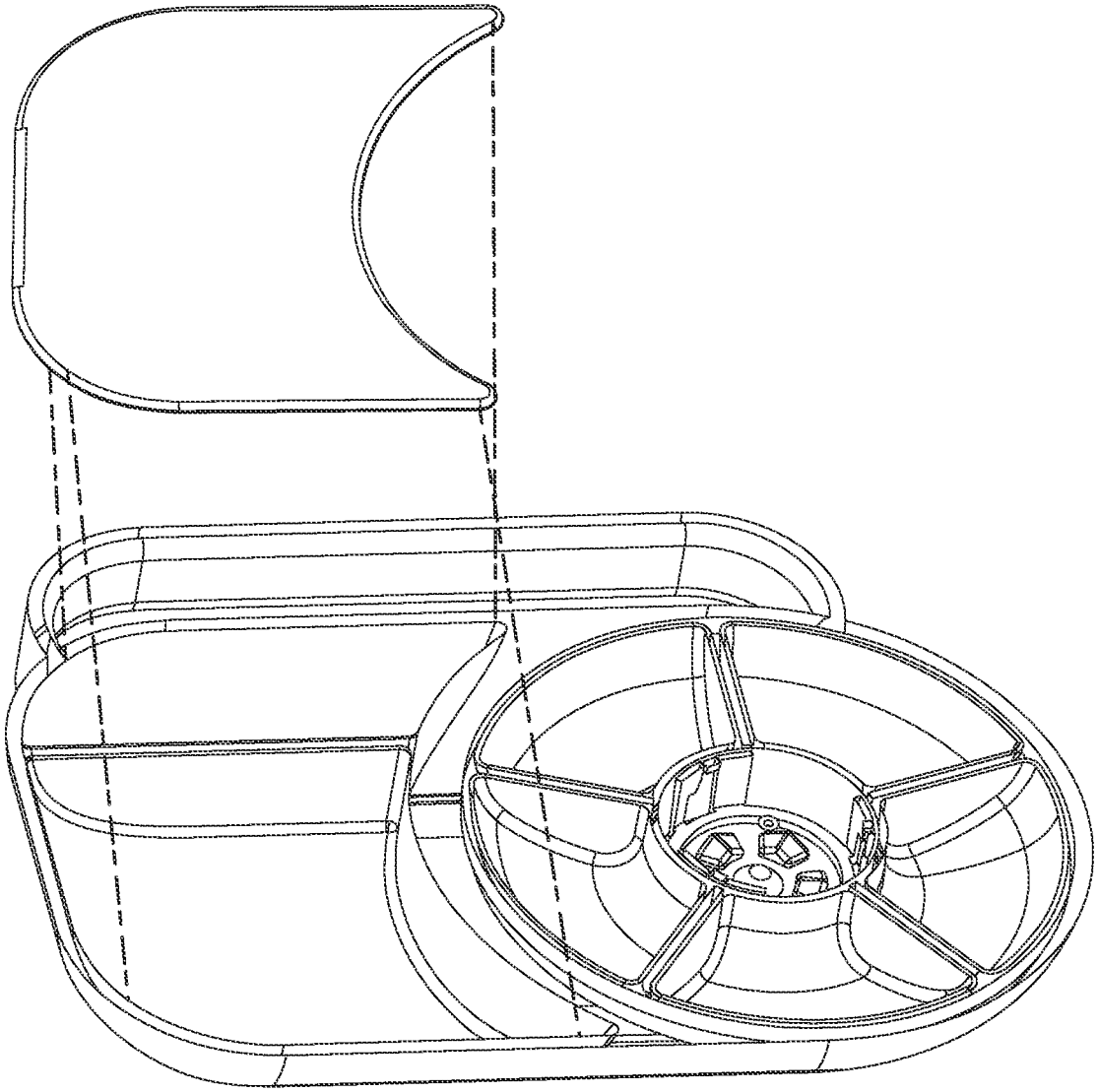
FIG. 23 is the same as FIG. 15 but the lid exploded away to reveal the compartment for placing food items therein.

Rotation mechanism 94 includes a base 106 and a tubular portion 108, as shown in FIGS. 8-10. Base 106 includes a cavity 110 configured for disposal of protrusion 36 to facilitate rotation of tray 14. Base 106 includes a plurality of extensions 112 circumferentially and equidistantly disposed about cavity 110. Extensions 112 protrude distally and are configured for disposal in gaps 37 of housing 30. Extensions 112 define drive pockets 114 therebetween. Drive pockets 114 are configured for disposal of knobs 37. During rotation, extensions 112 are configured to translate along ramp surface 40, over apex 44 and along ramp surface 42 such that knob 37 is disposed with an adjacent drive pocket 114 to facilitate selective rotation of tray 14.

Tubular portion 108 includes an inner surface 120 that defines a cavity 122. Cavity 122 is configured for disposal of a biasing member, for example, a spring. The biasing member is configured to spring load button 90. The biasing member biases button into the release orientation between rotations of tray 14.

Tubular portion 108 includes an outer surface 130. Surface 130 includes a plurality of vertical channels 132 connected by transverse channels 134. At least one vertical channel 132 includes a ramped surface 136, inclining from a distal end to a proximal end. At least one transverse channel 134 includes a ramped surface 138, inclining from the proximal end towards the distal end. Channels 132 include a proximal portion 150 having a wall 154. Wall 154 is configured to resist and/or prevent unwanted rotation of actuator 80. Upon actuation, for example, pressing button 90 downward, as shown by arrow A in FIG. 7, pin 104 translates around wall 154 and distally along transverse channel 134. This causes rotation, in a direction shown by arrow B in FIG. 7, of rotation mechanism 94 and simultaneous rotation of tray 14. Releasing button 90, in a direction shown by arrow C in FIG. 7, causes pin 104 to translate proximally along channel 132 and into engagement with an adjacent proximal portion 150 and wall 154.

In some embodiments, tray 14 includes five pockets 18 and the selective rotation is one fifth of 360 degrees, for example, each rotation is 72 degrees. This selective rotation of 72 degrees is accomplished by collar 92 having five pins 104, rotation mechanism 94 having five vertical channels 132 and five transverse channels 134 equally disposed about rotation mechanism 94.

Container system 10 can be assembled and disassembled for cleaning and/or storage. For example, actuator 80 device is assembled such that the actuator 80 is rotatably positioned within lid 50 and housing 30 and actuator 80 is connected with lid 50 via spring tabs 82. Tray 14 is placed within bowl 24 such that tray 14 may substantially freely rotate. Base 106 is placed in housing 30 such that the drive pockets 114 are in drive contact with the knobs 38, and such that lid 50 comes into engagement contact with bowl 34.

With container system 10 assembled, actuator 80 is actuated, as described herein, which in turn causes tray 14 to index and/or rotate a predetermined and/or selected amount relative to bowl 24 such that an exposed pocket 18 is accessible and an unexposed containment compartment is closed. When the containment compartments contain a snack, a user, especially a child, experiences the entertainment and autonomy of choosing which snack to expose and subsequently retrieve and consume. It shall be noted that if all of the compartments contain a snack and the apparatus is overturned, only the snack in the open compartment is susceptible to spilling.

To build on the aforementioned invention, the instant invention defines that the attached food bowl/container/tray can be attached to the snack spinner in multiple ways. In the embodiment illustrated in FIGS. 15-18 a specialized lunch box is molded with a slot for placement therein of the spinning snack tray. In FIGS. 19-22, the spinning tray is attached above stackable compartments that can hold lunch items. In both embodiments the spinning snack tray is easily attached and removed.

These embodiments are intended to be used to carry food such as a school lunch and is designed for kids as young as preschool age and older. However, adults can use the device as well. The method of attachment is intended to be easy enough for most preschool aged children to operate by themselves. The container may contain a rubber or silicone seal to create an airtight seal around the container and lid. The container may be made of plastic, wood, metal, glass or any other rigid, food-safe material. The container may be cylindrical, bowl-shaped, or rectangular-shaped. The container may be clear or opaque. The container may use hinges, magnets, clasps, pressure fits, compliant mechanisms, stretchy bands or any other mechanism to securely attach the lid and snack spinner to the lunch container.

The embodiment shown in FIGS. 15-18 the spinning tray sets in a recessed portion 200 of the attached container 202 that can open up to house more foods or snacks. Attached to the container 202 is a handle 204 to make the device easy to carry. Adjacent the recessed portion 200 is container 202 that has a lid 206 that opens at a hinge 208 to reveal an inside portion that can contain food or snacks. A lip 210 is attached to the side 212 of the container 202 to allow for easy opening of the lid 206 at the hinge 208.

FIGS. 19-22 show an alternate embodiment wherein the spinning tray is set on top of a bucket-style lunch box 214. The lunch box 214 is substantially cylindrical and has a top rim 216. Attached to the top rim 216 is a handle 218 that makes the bucket style lunch box easy to carry. The bucket style lunch box can have one or more compartments 220 that are stacked on top of each other and that can be separated from each other through an actuator 222. The top rim 216 surrounds a space 224 into which the tray can be secured.

The invention illustratively disclosed herein suitably may be practiced in the absence of any element which is not specifically disclosed herein.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A snack compartment and dispensing apparatus and lunch box combination, comprising:

an apparatus base having a detachable tray portion and a detachable lunch box lid portion arranged in a horizontal, side-by-side orientation, said detachable tray portion including one or more pockets;

a lid connectible with said detachable tray portion and including an opening, said tray being configured for selective rotation relative to said lid to align one of said one or more pockets with said opening;

an actuator configured to actuate rotation of said tray, said actuator including a rotation mechanism that includes a base and a tubular portion, said tubular portion including a plurality of vertical channels connected by a plurality of transverse channels to facilitate selective rotation of said tray; and said apparatus base containing a lunch box recess covered by a lunch box cover portion and a second recess formed to contain said tray portion where said lunch box portion recess and said tray portion recess are connected in a horizontal, side-by-side arrangement;

where said tray portion and said lunch box portion are contained within said apparatus base so as to be transported as a single apparatus when said lunch box cover is positioned to enclose said connected lunch box portion and said tray portion is contained within said apparatus base.

2. The snack compartment and dispensing apparatus and lunch box combination of claim 1 wherein said tray portion and lunch box portion combination and detachable lunch box lid further comprises a handle attached thereto.

3. The snack compartment and dispensing apparatus and lunch box combination of claim 1 wherein said detachable lunch box includes at least one compartment for the secure placement therein of food items wherein said compartment can be opened and closed.

4. The snack compartment and dispensing apparatus and lunch box combination of claim 3 wherein said at least one compartment is positioned adjacent to said recessed portion.

5. The snack compartment and dispensing apparatus and lunch box combination of claim 3 wherein said at least one compartment is positioned below said recessed portion.

6. A snack compartment and dispensing apparatus and lunch box combination comprising:

a bowl;

a lid connectible with said bowl, said lid including an opening having a hinged flap;

a detachable tray disposed with said bowl, said tray including one or more pockets configured for selective rotation relative to said bowl to align one of said one or more pockets with said opening;

a plunger button configured to actuate rotation of said tray, said plunger button including a rotation mechanism that includes a base and a tubular portion, said tubular portion including a plurality of vertical channels connected by a plurality of transverse channels to facilitate selective rotation of said tray; and a specialized lunch box base comprising a detachable lunch box cover and wherein said lunch box base includes a recessed portion having side-by-side compartments for the placement within said bowl portion and said lunch box portion connected in a horizontal, side-by-side arrangement with said detachable lunch box cover positioned to enclose said lunch box portion within said specialized lunch box base;

where said tray portion and said lunch box portion are connected so as to be transported as a single apparatus when said lunch box lid and said tray are positioned in the side-by-side arrangement.

7. The snack compartment and dispensing apparatus and lunch box combination of claim 6 wherein said bowl and lunch box combination and detachable lunch box lid further comprises a handle attached thereto.

8. The snack compartment and dispensing apparatus and lunch box combination of claim 6 wherein said detachable lunch box includes at least one compartment for the secure placement therein of food items wherein said compartment can be opened and closed.

9. The snack compartment and dispensing apparatus and lunch box combination of claim 8 wherein said at least one compartment is positioned adjacent to said recessed portion.

10. A snack compartment and dispensing apparatus and lunch box combination of claim 8 wherein said at least one compartment is positioned below said recessed portion.

* * * * *